US008733018B2

(12) United States Patent
Couturier et al.

(10) Patent No.: US 8,733,018 B2
(45) Date of Patent: May 27, 2014

(54) LOUVER BLIND STRUCTURE IN A DOUBLE GLAZED WINDOW UNIT

(75) Inventors: Jean-François Couturier, Outremont (CA); Qian Peng, Montreal (CA)

(73) Assignee: Unicel Architectural Corp., Longueuil, Quebec (CA)

( * ) Notice: Subject to any disclaimer, the term of this patent is extended or adjusted under 35 U.S.C. 154(b) by 0 days.

(21) Appl. No.: 13/394,231

(22) PCT Filed: Sep. 3, 2010

(86) PCT No.: PCT/CA2010/001396

§ 371 (c)(1), (2), (4) Date: Mar. 5, 2012

(87) PCT Pub. No.: WO2011/026245

PCT Pub. Date: Mar. 10, 2011

(65) Prior Publication Data

US 2012/0159850 A1 Jun. 28, 2012

Related U.S. Application Data

(60) Provisional application No. 61/272,239, filed on Sep. 3, 2009.

(51) Int. Cl.
*E05B 65/04* (2006.01)
*E05C 7/02* (2006.01)

(52) U.S. Cl.
USPC ..... 49/67; 49/62; 49/63; 49/64; 49/65

(58) Field of Classification Search
USPC ..... 49/61, 62, 63, 64, 65, 67; 160/107
See application file for complete search history.

(56) References Cited

U.S. PATENT DOCUMENTS

| | | | | |
|---|---|---|---|---|
| 361,019 | A | 4/1887 | Morstatt | |
| 421,047 | A | 2/1890 | Hantsche, Jr. | |
| 2,486,000 | A * | 10/1949 | Browning | 160/176.1 R |
| 2,903,257 | A | 9/1959 | Perrone | |
| 3,201,832 | A * | 8/1965 | Hordis et al. | 49/64 |
| 3,685,205 | A * | 8/1972 | Requena | 49/64 |
| 3,702,040 | A * | 11/1972 | Roy | 49/64 |
| 3,991,518 | A | 11/1976 | Ishihara | |
| 4,484,611 | A * | 11/1984 | Anderson | 160/107 |
| 4,586,289 | A * | 5/1986 | Jaeger | 49/64 |
| 4,702,296 | A * | 10/1987 | Anderson | 160/107 |
| 5,216,837 | A * | 6/1993 | Cleaver et al. | 49/82.1 |
| 5,600,920 | A | 2/1997 | Roy | |
| 6,094,864 | A * | 8/2000 | Hsu | 49/82.1 |
| 6,230,442 | B1 * | 5/2001 | Kokar | 49/64 |
| 7,128,120 | B2 * | 10/2006 | Orbeck et al. | 160/89 |
| 2004/0069417 | A1 * | 4/2004 | Sun et al. | 160/107 |

* cited by examiner

*Primary Examiner* — Jerry Redman
(74) *Attorney, Agent, or Firm* — EQUINOX IP; Franz Bonsang

(57) ABSTRACT

A louver blind structure comprises a frame with a plurality of louver members pivotally mounted at each longitudinal end thereof to the frame so as to pivot between open and closed positions. An elongated member is movable relative to the frame and is so positioned as to engage the louver members. An actuator is mounted to the frame for selectively imparting a movement to the elongated member. When imparting a movement to the elongated member the louver members engaged thereby are caused to pivot between the open and closed positions. A kit comprising this actuator and the elongate member for a louver blind structure is also provided.

9 Claims, 9 Drawing Sheets

48D
58D
60D
56

48C
58C
60C
56

48
58
68
70
56
64
60
73
66
62

48B
58B
60B
56

LOUVER BLIND STRUCTURE IN A DOUBLE GLAZED WINDOW UNIT

CROSS-REFERENCE TO RELATED APPLICATIONS

The present application claims priority on U.S. Provisional Patent Application No. 61/272,239 filed on Sep. 3, 2009 and incorporated herein by reference in its entirety.

TECHNICAL FIELD

The present disclosure relates to a louver blind structure mounted within a double glazed sealed window unit. More particularly but not exclusively, the present disclosure relates louver structure including an actuator for causing louvers of a louver blind structure to pivot between closed and opened positions.

BACKGROUND

Louver blind structures are well known in the art. These structures are located within the inner chamber of a window unit and include a plurality of louver members or slat members which are equally spaced and horizontally disposed. The louver member can pivot from a vertical position slightly overlapping one another to form a uniform vertical surface that blocks light from streaming therethrough. The louver members can also be pivoted into a horizontal position in order to let light pass between adjacent and spaced apart louver members.

A drawback of conventional louver blind structure is that they are thick and large structures and thus cannot be positioned in smaller or thinner window structures. This larger structure is a result of cumbersome actuation systems for pivoting the louver members.

OBJECTS

It is an object of the present disclosure to provide a louver blind structure.

It is an object of the present disclosure to provide louver blind structure in a double glazed window unit It is an object of the present disclosure to provide a kit for a louver blind structure.

SUMMARY

In accordance with an aspect of the present disclosure, there is provided a louver blind structure comprising:

a frame;

a plurality of louver members pivotally mounted at each longitudinal end thereof to the frame so as to pivot between open and closed positions;

an elongated member being movable relative to the frame and so positioned as to engage the louver members;

at least one actuator mounted to the frame for selectively imparting a movement to the elongated member, wherein imparting a movement to the elongated member causes the louver members engaged thereby to pivot between the open and closed positions.

In an embodiment, the elongated member is movably mounted to the frame.

In an embodiment, the frame comprises frame members, the actuator being mounted to one of the frame member. In an embodiment, the elongated member is movably mounted to the one frame member. In an embodiment, the one frame member comprises a channel for receiving the elongated member therein, the elongated member being movable within the channel. In an embodiment, the one frame member comprises a main longitudinal body and an auxiliary longitudinal body mounted thereto for defining the channel therebetween. In an embodiment, the main body defines the outer side of the one frame member and wherein the auxiliary body defines the inner side of the one frame member. In an embodiment, the actuator is mounted on the outer side and protrudes through the main body so as to engage the elongated member within the channel.

In an embodiment, the one frame member comprises a lateral side frame member. In an embodiment, the elongated member is movable between upward and downward directions. In an embodiment, when the elongated member is moved upwardly it so engages the louver members as to cause them to pivot to the open position and wherein when the elongated member is moved downwardly it so engages the louver members as to cause them to pivot to the closed position.

In an embodiment, the louver members comprise respective pivot members, the elongated member comprising a plurality of opening, each opening receiving at least a portion of a respective pivot member. In an embodiment, each respective member is positioned at a the longitudinal end of the louver member. In an embodiment, movement of the elongated member so interferes with the pivot members as to impart a pivot movement thereto, thereby, causing a corresponding pivot of the louver members.

In an embodiment, the actuator engages the elongated member. In an embodiment, the actuator comprises a cam for engaging the elongated member. In an embodiment, the cam comprises a roller for rollingly engaging the louver member. In an embodiment, the elongated member comprises a slot for being engaged by the actuator.

In an embodiment, the actuator provides for moving the elongated member in an upward and downward direction. In an embodiment, the actuator comprises a portion thereof mounted externally of the frame and a portion thereof mounted within the frame. In an embodiment, the actuator comprises a portion thereof mounted internally of the frame. In an embodiment, the actuator portion mounted externally of the frame comprises a control for selectively imparting a movement to the elongated member. In an embodiment, the control comprises a manual control. In an embodiment, the manual control comprises a gear. In an embodiment, the control comprises a motor. In an embodiment, the control actuates a gear assembly for imparting a movement to the elongated member. In an embodiment, the actuator portion mounted internally of the frame engages the elongated member.

In an embodiment, the frame comprises a rectangular configuration.

In an embodiment, the louver blind structure comprises a pair of window panels mounted to the frame with the plurality of the louver members being positioned therebetween.

In accordance with an aspect of the present disclosure, there is provided kit for a louver blind structure including a frame and a plurality of louver members pivotally mounted at each longitudinal end thereof to the frame so as to pivot between open and closed positions, the kit comprising an actuator for being mounted to the frame;

an elongated member for being positioned along at least a portion of the frame so as to engage the louver members, the elongate member being engaged by the actuator which imparts a movement relative to the frame wherein imparting a movement to the elongated member causes the louver members engaged thereby to pivot between the open and closed positions.

In accordance with a non restrictive illustrative embodiment of, there is provided a louver blind structure including: an actuator assembly mounted to at least one side of the structure; and an elongated member is in a slidable relationship with the at least one side of the structure thereby vertically movable relative the at least side, the elongated member interfering with the louver members so as to cause a relative pivot when being moved; wherein the actuator assembly selectively actuates the elongated member to causing the louver members to pivot between opened and closed positions.

In an embodiment the louver blind structure comprises: four interrelated sides defining a generally rectangular configuration, louver members extending between lateral sides of the structure being pivotally mounted thereto; a vertically movable element including openings for receiving a portion of the louver blind members therethrough and being mounted to the inner side of at least one lateral side structure; an actuator assembly comprising an external portion that is mounted to the external side of the at least one lateral side structure and including a protruding portion mounted through the at least one lateral side structure for engaging the vertically movable member, the external portion of the actuator assembly comprising an external actuator element for actuating an internal actuator element which provides for causing the vertical movement of the elongated, the vertical movement of this elongated side structure provides for moving the louver blind members between closed and opened positions.

Other objects, advantages and features of the present invention will become more apparent upon reading of the following non-restrictive description of illustrative embodiments thereof, given by way of example only with reference to the accompanying drawings.

DETAILED DESCRIPTION OF ILLUSTRATIVE EMBODIMENTS

Generally stated, in accordance with an embodiment, the present description provides a louver blind structure with an actuator mounted thereto for moving an elongated member also mounted to the structure. The elongated member engages the louver members of the blind structure so as to pivot them between closed and open positions. A pair of window panels can be mounted to the structure to enclose the louver members therebetween.

Figure 1:
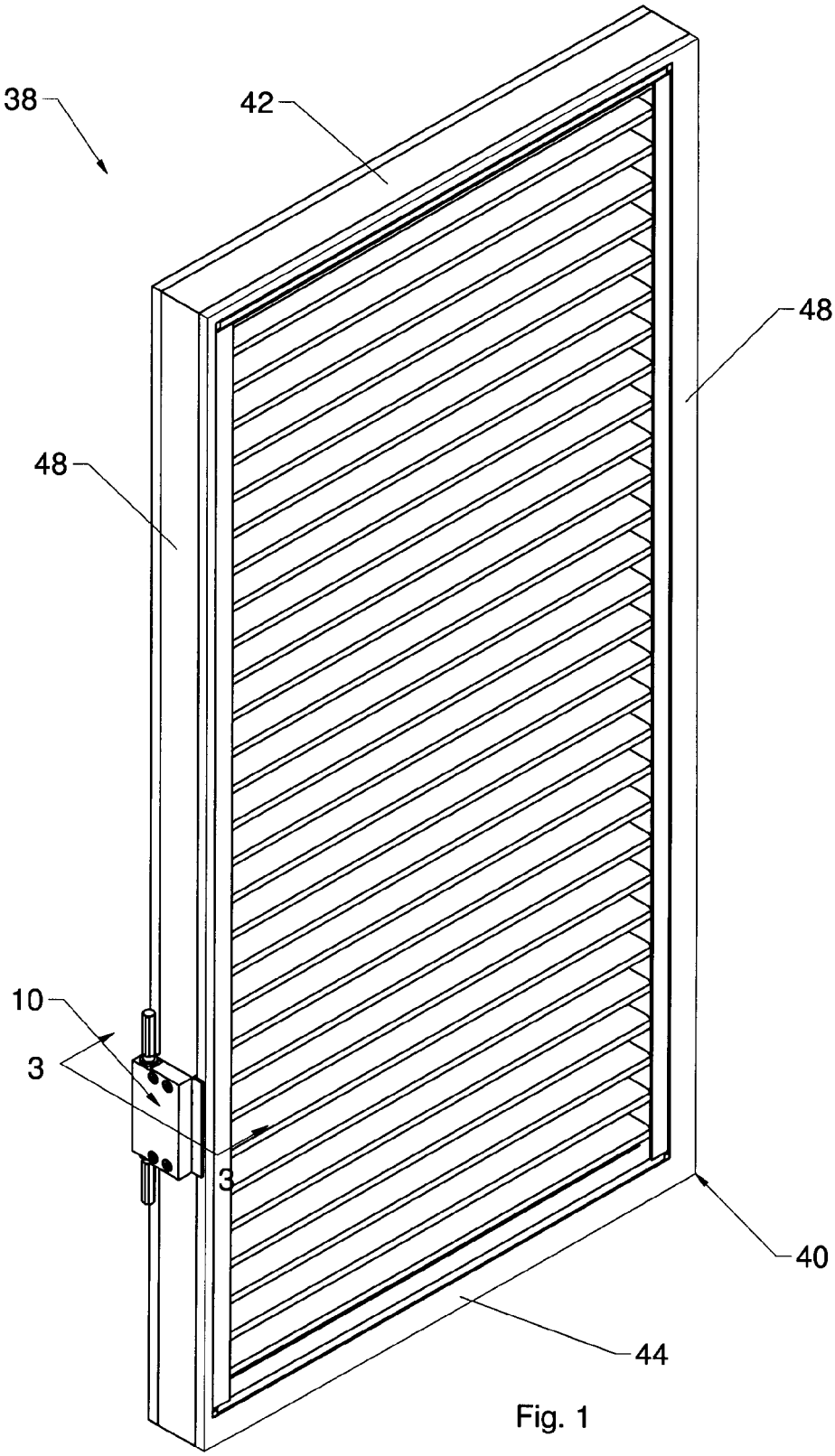
FIG. 1 is a perspective view of a louver blind structure in accordance with a non-restrictive illustrative embodiment of the present disclosure.

FIG. 1 shows a louver blind structure 38 including an actuator 10.

Figure 2:
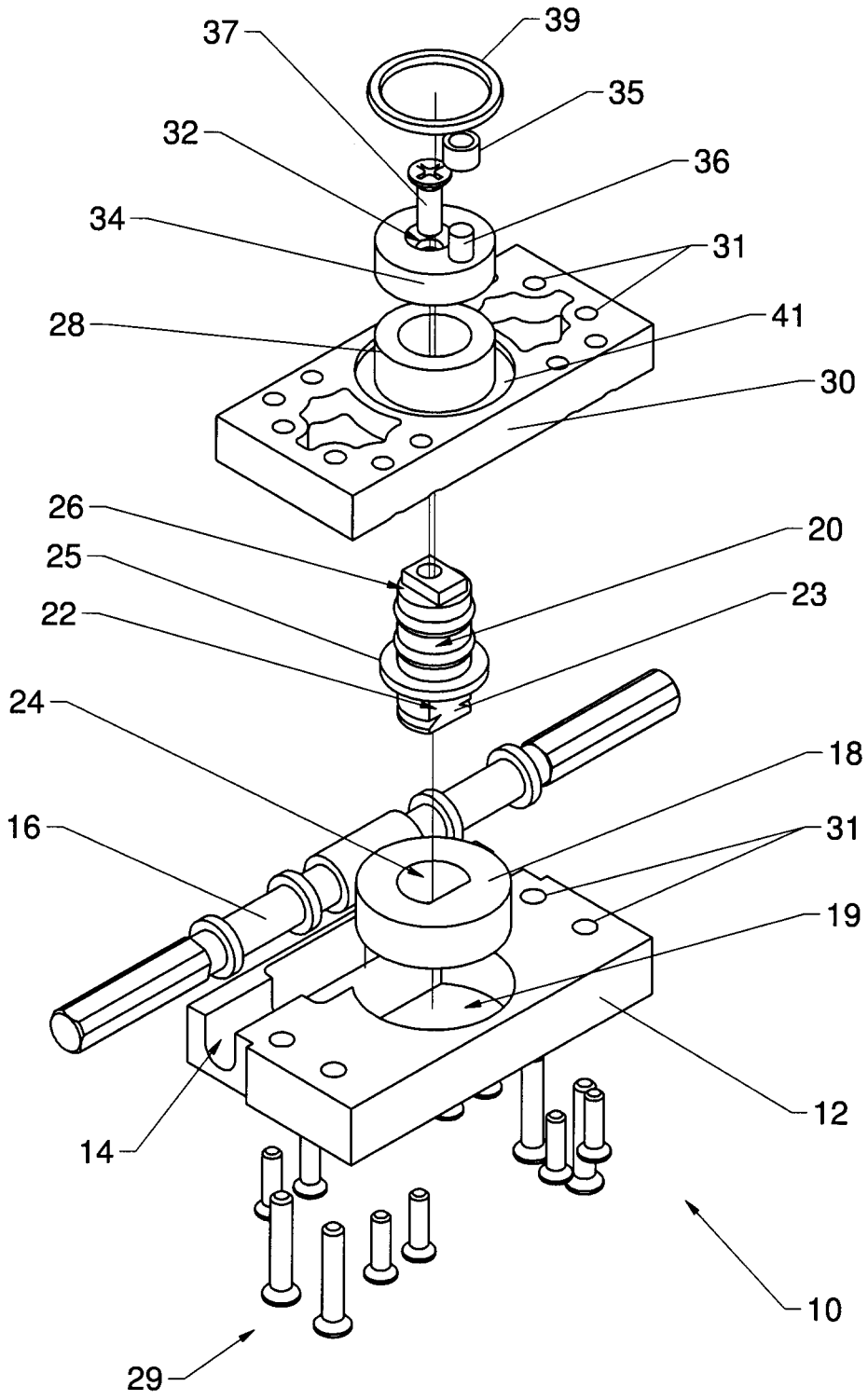
FIG. 2 is a perspective view of the actuator of the louver blind structure of FIG. 1.
Figure 3:
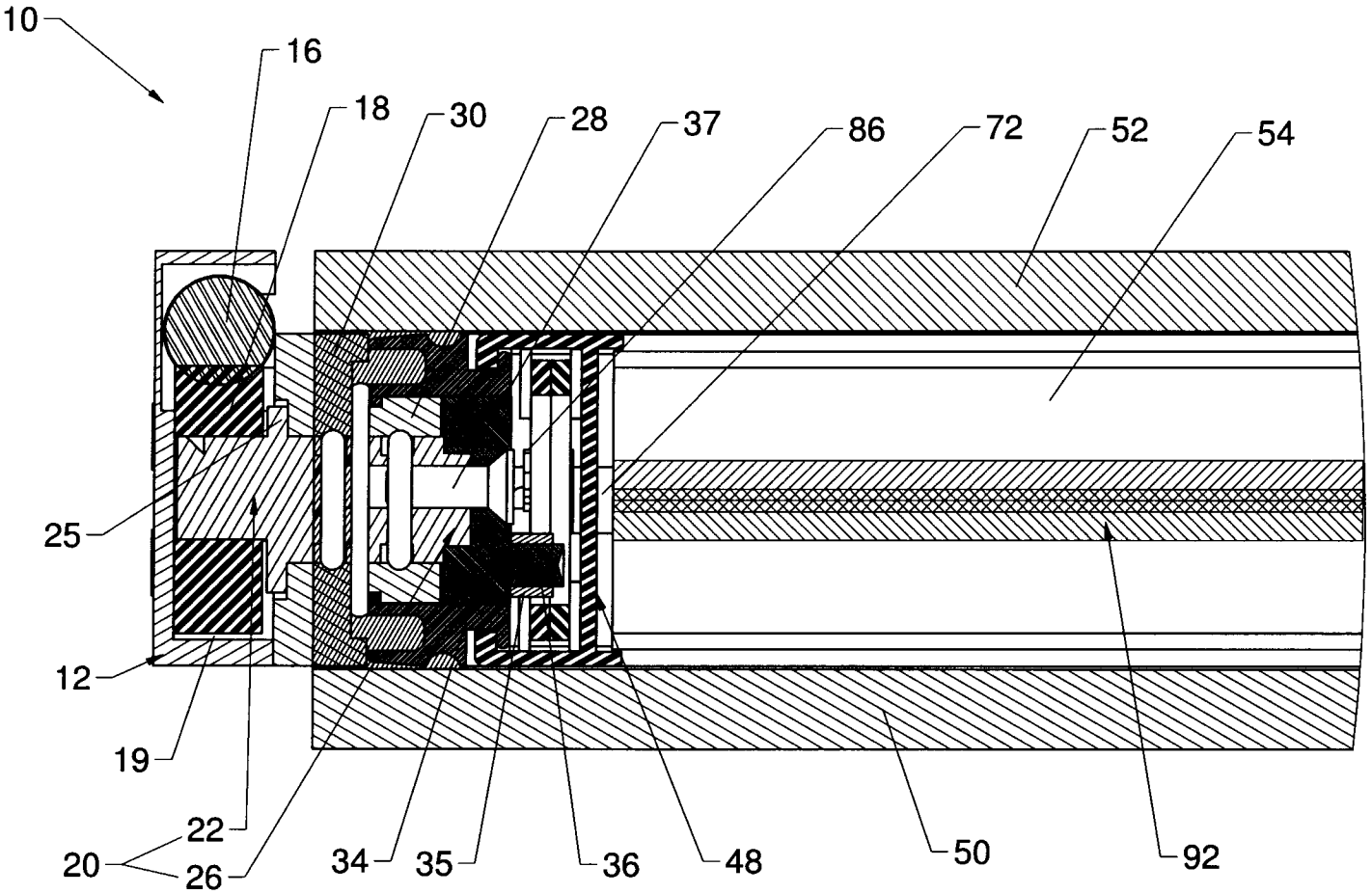
FIG. 3 is a section view of FIG. 1 taken along line 3-3 thereof.

Turning to FIGS. 2 and 3, the actuator 10 is provided in the form of an assembly comprising a base member 12 having a longitudinal slot 14 to receive a worm gear 16 which acts on a first or proximal circular gear element 18 fitted within an cavity 19 formed in the base 12.

The proximal circular gear element 18 receives a longitudinal gear rod 20. This gear rod 20 includes a circular base portion 22, with a flat part 23, fitted within a corresponding opening 24 of gear element 18 so as to rotate therewith. The base portion 22 is dependent from a ring structure 25 that rests on the gear element 18. The gear rod 20 includes a head portion 26 that is inserted within a tubular structure 28 formed within and extending from the cover 30 which is sealingly mountable to the base 12 via fasters 29 and mutually corresponding apertures 31.

The head portion 26 is mounted within the opening 32 of a second or distal circular gear element 34 slidably mounted to the tubular structure 28 and having a protruding element or cam 36 protruding therefrom. A roller 35 is rollingly mounted about the cam 36. A fastener 37 connects the gear rod 20 to the distal gear element 34. A ring seal 39 is positioned within a ring indenture 41 formed about the tubular structure 28.

As shown in FIGS. 1 and 3, the louver blind structure 38 includes a frame 40 having top and bottom members 42 and 44, respectively, and opposite lateral members 48. First and second window panels 50 and 52 are mounted to the frame 40 defining together with the frame 40 a chamber for receiving a plurality of louver members 54 therein. The louver members 54 extend between the spaced apart lateral members 48 and are pivotally mounted thereto.

Figures 7A, 7B, 7C, 7D:
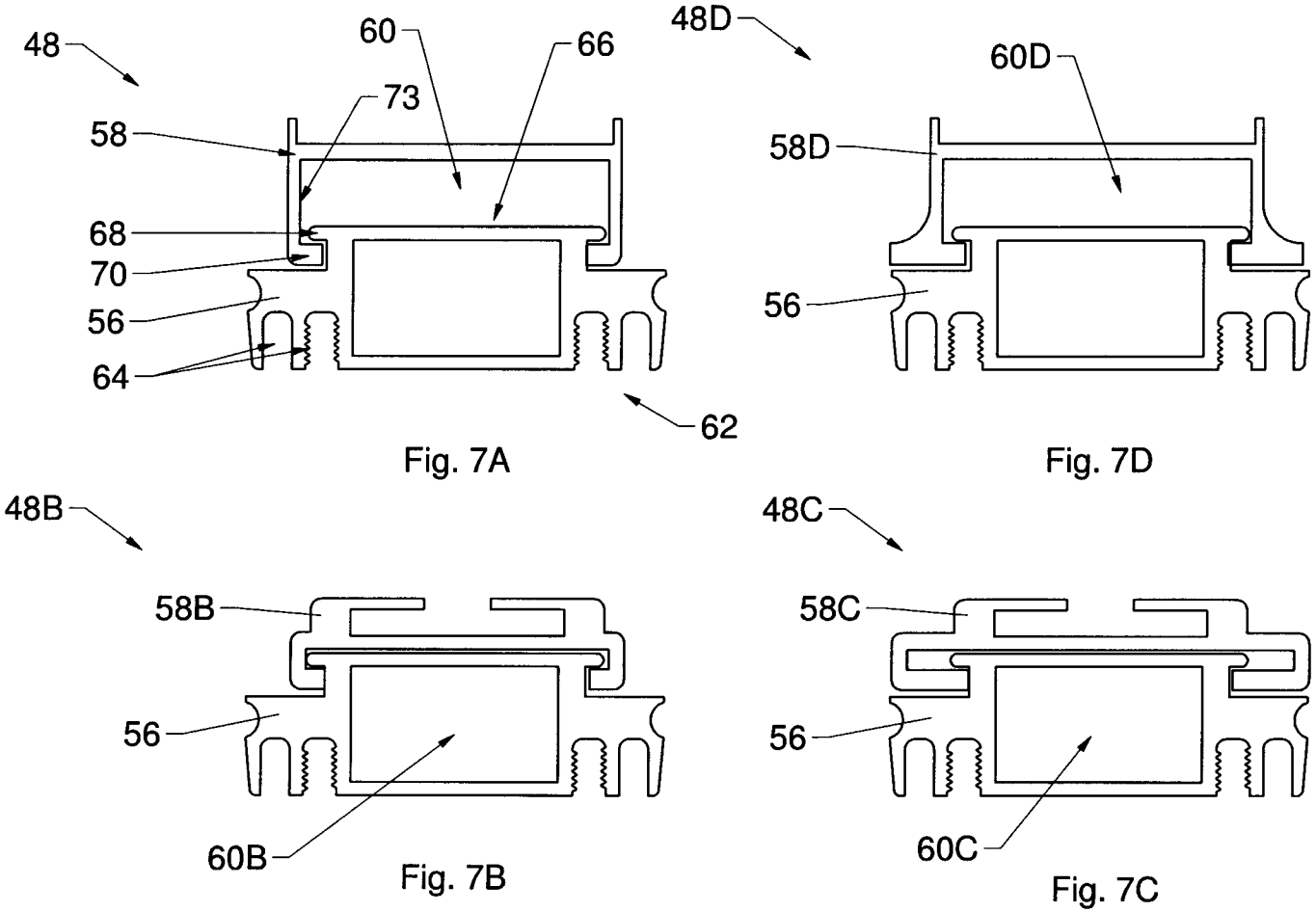
FIG. 7A is a top sectional view of the lateral frame member as shown in FIG. 3.
FIG. 7B is a top sectional view of a lateral frame member in similar to the view of FIG. 7A but in accordance with another non-restrictive illustrative embodiment of the present disclosure.
FIG. 7C is a top sectional view of a lateral frame member in similar to the view of FIG. 7A but in accordance with a further non-restrictive illustrative embodiment of the present disclosure.
FIG. 7D is a top sectional view of a lateral frame member in similar to the view of FIG. 7A but in accordance with yet another non-restrictive illustrative embodiment of the present disclosure.

With respect to FIGS. 1, 3 and 7A, the actuator 10 is mounted to one of the lateral members 48. This lateral member 48 includes a main body 56 with an auxiliary body 58 mounted thereto thereby forming a channel 60 therebetween. The main body 56 defines an outer side 62 thereof including apertures 64 for receiving fasteners 29 thereby mounting the actuator 10 thereto. The main body 56 also defines an inner face 66 forming a shoulder structure 68 for clipping the auxiliary body 58 thereto via its flanges 70 which engage the shoulder structure 68.

With respect to FIGS. 3, 4, 5 and 7A, a vertical and elongated member or blade 72 is movably mounted within channel 60. The blade 72 can also slide along the inner walls 73 formed by the auxiliary body 58 as well as along the inner side 66 of the main body 56. In any case, the blade 72 is movable relative to the lateral frame member 48.

Figure 4:
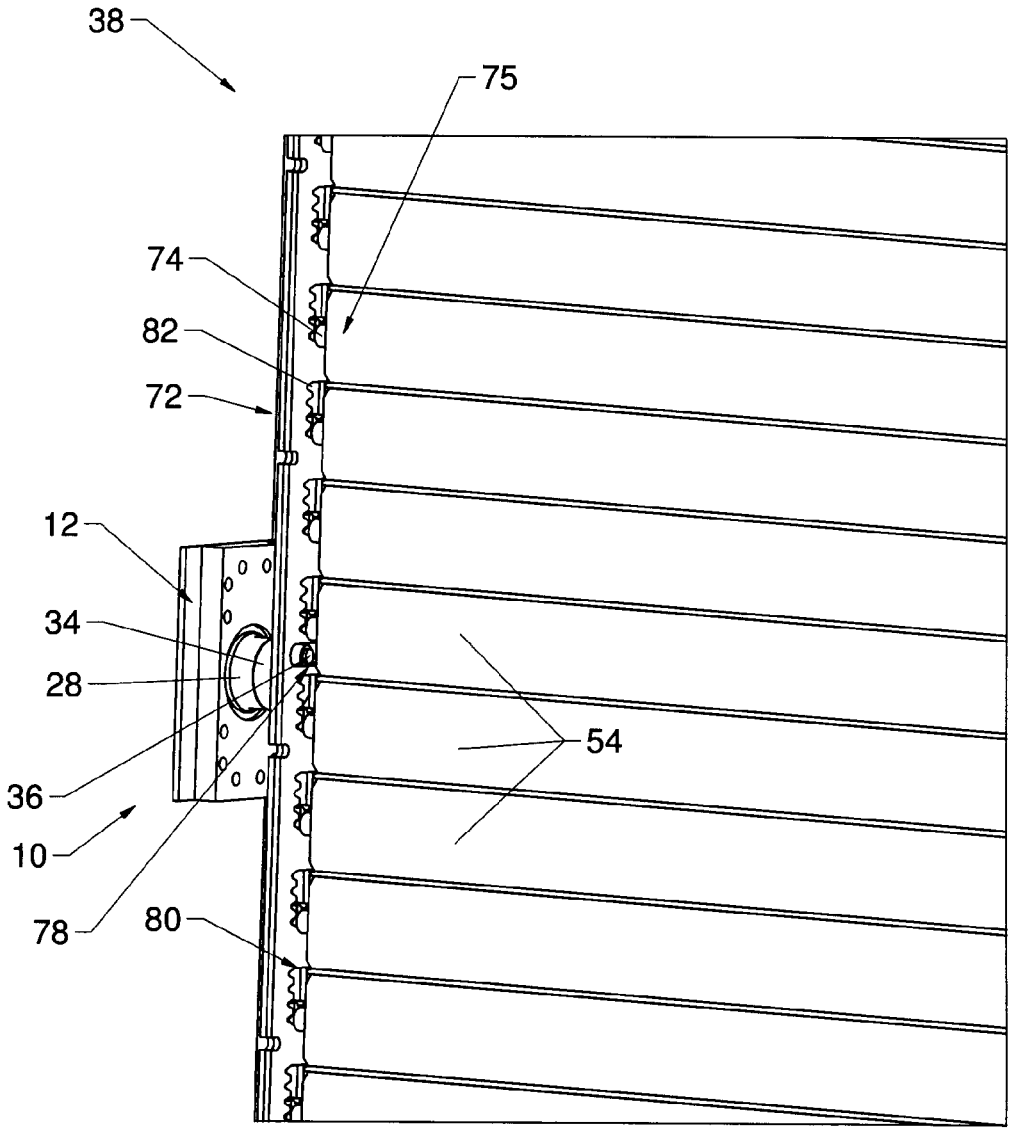
FIG. 4 is a perspective view of the actuator of FIG. 1 and the louver members of the louver blind structure of FIG. 1 in a closed position with an elongated member operationally positioned therebetween in accordance with a non-restrictive illustrative embodiment of the present disclosure.

Turning to FIG. 4, a pivot element 74 protrudes from the longitudinal ends 75 of the louver members 54 and is pivotally mounted to the lateral frame 48 via openings (not shown) provided in the auxiliary body 58. The opposite lateral frame 48 can be provided in the same configuration or in another standard configuration as is known in the art. In any case, the louver members 54 are also pivotally mounted to the opposite and spaced apart lateral frame members 48.

With reference to FIGS. 2 and 7A, the main body 56 of the lateral frame member 48 defines a chamber 76 for receiving parts of the actuator 10 therein. As such, the outer side 62 includes openings (not shown) which are contiguous with the chamber 76. Similarly, the inner face 66 of the main body 56 also includes openings (not shown) which are contiguous with the channel 60. The foregoing provides for operational communication between the actuator 10 (which is partially external and partially internal to the double glazed window structure) and the blade 72.

It should be noted that the operational communication between the actuator 10 the louvers 54 is completely sealed. Thus all the openings mentioned herein in order to provide for this operational communication are sealed so as to isolate and seal the chamber defined by the frame 40 and the window panels 50 and 52 from the external environment.

The blade 72 includes at least one slot 78 for receiving the cam 36 with its roller 35 therein.

The blade 72 also includes openings 80 defining jagged rims 82 through which the pivot elements 74 are positioned.

With reference to FIGS. 4, and 6A to 6D, each pivot element 74 includes a main elongated body 84 that is almost entirely inserted within its respective louver member 54 and includes a gear 86 at one end thereof comprising wing members 88. The gear 86 protrudes outwardly of the louver member 54 so as to be positioned within the adjacent opening 80 of the blade 72. More particularly, the wing members 88 mate with the jagged rims 82. The main elongated body 84 comprises a longitudinal recess 90 for being mounted to an inner structural portion 92 of the louver member 54 (see FIG. 3).

Figure 5:
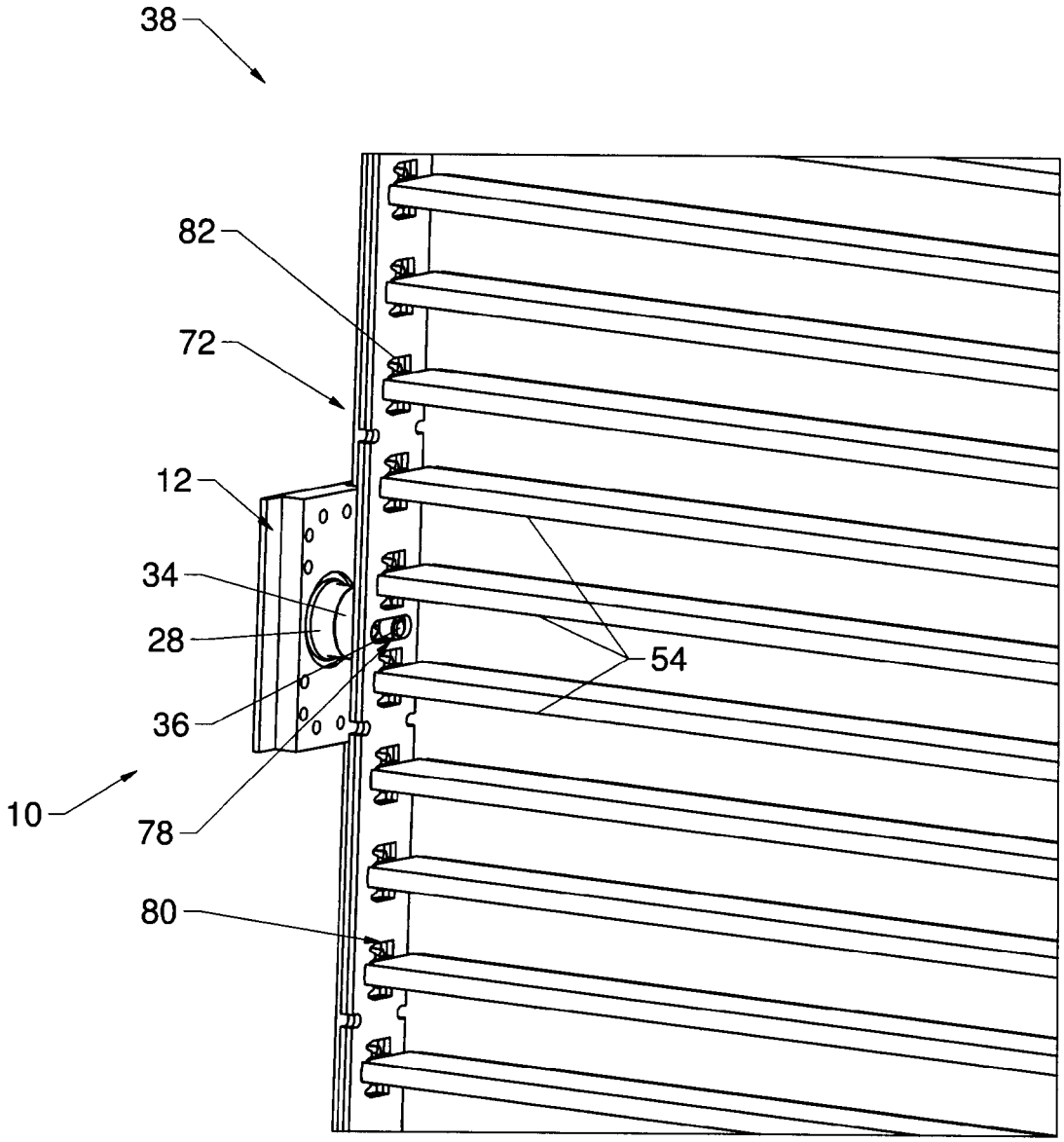
FIG. 5 is a perspective view of the actuator of FIG. 1 and the louver members of the louver blind structure of FIG. 1 in a open position with an elongated member operationally positioned therebetween in accordance with a non-restrictive illustrative embodiment of the present disclosure.
Figure 6A:
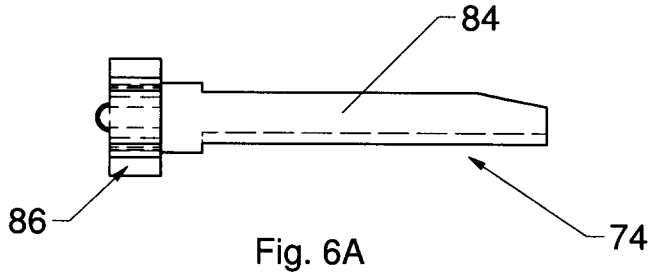
FIG. 6A is a lateral side view of the pivot member of the louver members shown in FIGS. 3 and 4 in accordance with a non-restrictive illustrative embodiment of the present disclosure.
Figure 6B:
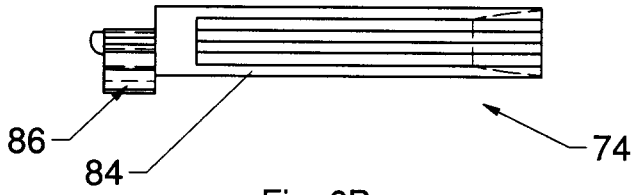
FIG. 6B is a top plan view of the pivot member of FIG. 6A.
Figure 6C:
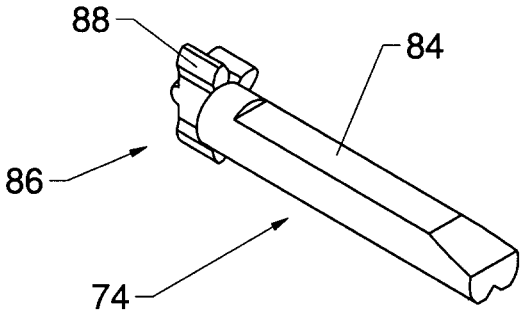
FIG. 6C is perspective view of the pivot member of FIG. 6A.
Figure 6D:
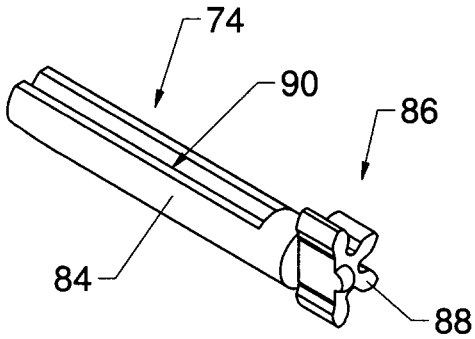
FIG. 6D is perspective view of the pivot member of FIG. 6A that is opposite the view of FIG. 6C.
Figure 6E:
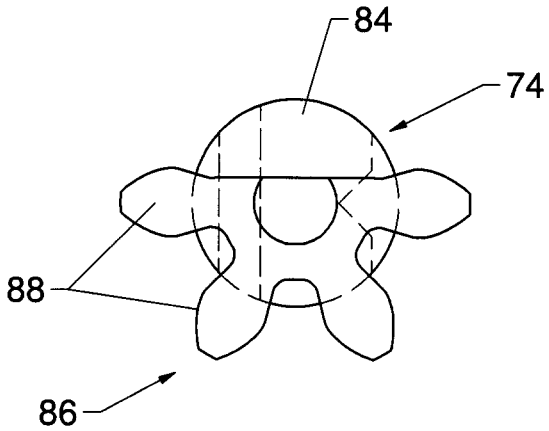
FIG. 6E is an end view of the pivot member of FIG. 6A.

The louver members 54 can pivot from a first generally vertical position, shown in FIG. 4 and referred to herein as a closed position, in which they may slightly overlap one another so as to form a generally uniform surface that may block almost completely light streaming through the window to a second generally horizontal position, shown in FIG. 5 and referred to herein as an open position, in which the louver members 54 provide for horizontal openings therebetween allowing for light to stream through these openings. In another embodiment, the louver members 54 can be vertically positioned. As such, the closed position will refer to the louver members substantially preventing light from streaming therebetween and the open position will refer to the louver members allowing for light to substantially stream therebetween.

In operation, when the louver members 54 are in the closed position, actuation of the worm gear 16 causes the proximal base gear 18 to rotate thereby rotating therewith the rod gear 20 which in turn rotates the distal gear 34. As such the cam 36 acts on the blade 72 via slot 78. More specifically the cam 36 is moved upwardly and hence, the roller 35 rolls along the inner rim of the slot 78 from one end thereof shown in FIG. 4 to the other end thereof shown in FIG. 5. The foregoing causes the blade 72 to move upwardly from within the channel 60 and relative to the lateral frame member 48 from an initial position shown in FIG. 4 to an upward position shown in FIG. 5.

As the blade 72 moves upwardly, the rims 82 of the openings 80 interfere with the wing members 86 causing the pivots 74 to turn thereby pivoting their corresponding louver members 54 from the closed position (FIG. 4) to the open position (FIG. 5).

When the worm gear 16 is turned in the opposite direction this will result in the cam 36 pushing the blade 72 downwardly from the initial upwards position shown in FIG. 5 to the downwards position shown in FIG. 4 as the roller 35 rolls along the inner edge of the slot 78 from one end thereof shown in FIG. 5 to the other end thereof shown in FIG. 4. As the blade 72 moves downwardly the rims 82 of the openings 80 interfere with the wing members 86 causing the pivots to turn in the opposite direction thereby closing the louver members as shown in FIG. 4.

Therefore, the worm gear 16 acts as control for the gear assembly which ultimately provides for the cam 36 to act on blade 72. Of course, this control need not be manual it can also be motorized.

With respect to FIGS. 7B, 7C and 7D there is shown other embodiments of lateral members for mounting the actuator 10 thereto, respectively illustrated are lateral members 48B, 48C and 48D. Lateral members 48B, 48C and 48D respectively include auxiliary bodies 56B, 56C and 56D with each being mounted to a respective longitudinal body so as to define channels 60B, 60C and 60D, respectively.

Figure 8:
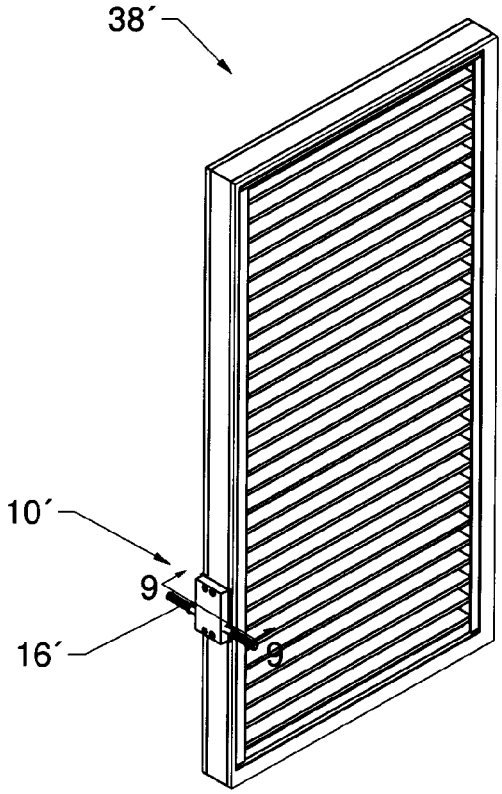
FIG. 8 is a perspective view of a louver blind structure in accordance with another non-restrictive illustrative embodiment of the present disclosure.
Figure 9:
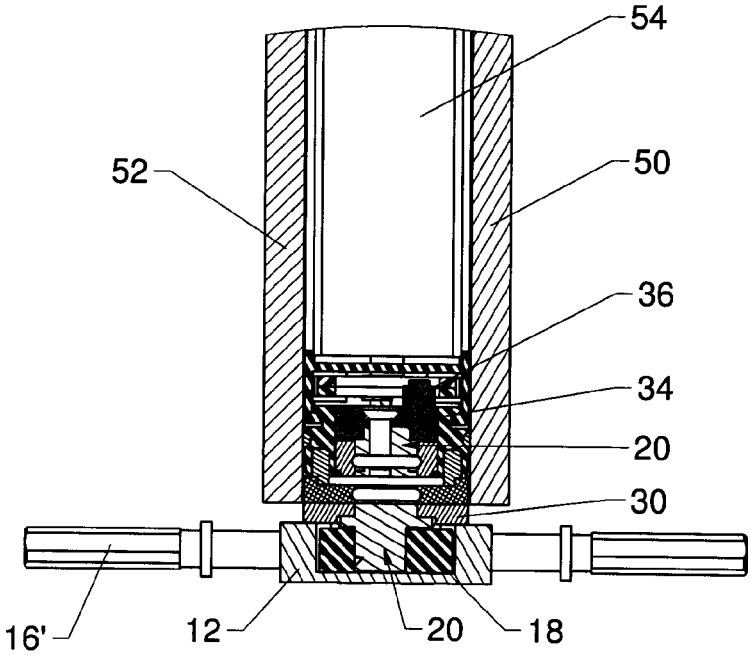
FIG. 9 is a section view of FIG. 8 taken along line 9-9 thereof.

Turning to FIGS. 8 and 9, there is shown a louver structure 38' including an actuator 10'. The louver structure 38' is similarly constructed to louver structure 38. The difference between actuator 10' and actuator 10 is that the worm gear 16' of the former is positioned horizontally with respect to worm gear 16. Worm gear 16' provides for the same actuation of the gear 18 which acts on gears 20 and 34 and ultimately on the cam 36 as previously described and as such need not be discussed any further for concision purposes only.

Figure 10:
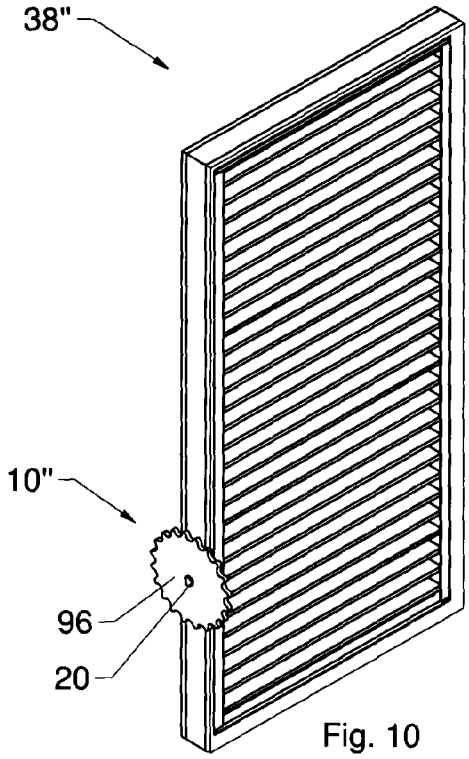
FIG. 10 is a perspective view of a louver blind structure in accordance with another non-restrictive illustrative embodiment of the present disclosure.

FIG. 10 shows a louver structure 38" including an actuator 10" including a large circular gear 96 with a toothed outer perimeter for acting on the gear rod 20 thereby foregoing the worm gear 16 and its associated proximal gear 18.

Figure 11:
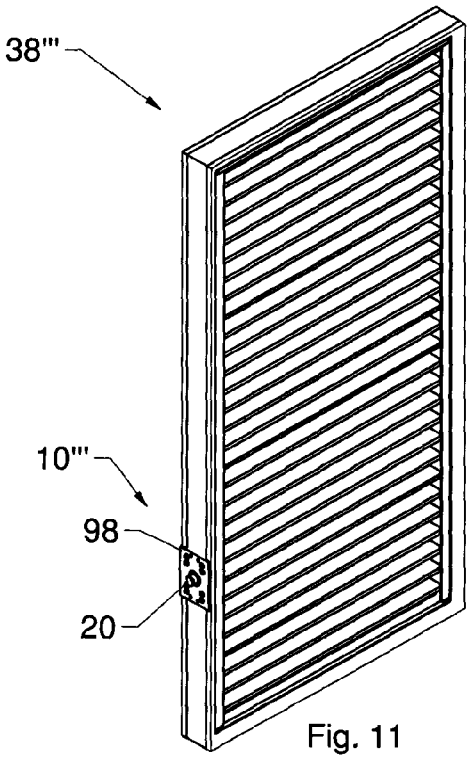
FIG. 11 is a perspective view of a louver blind structure in accordance with another non-restrictive illustrative embodiment of the present disclosure.

FIG. 11 shows a louver structure 38'" including an actuator 10'", a plate 98 provides for receiving a motor for actuating the gear rod 20.

The various features described herein can be combined in a variety of ways within the context of the present description so as to provide still other embodiments. It is to be understood that the present description is not limited in its application to the details of construction and parts illustrated in the accompanying drawings and described hereinabove. The description is capable of other embodiments and of being practiced in various ways. It is also to be understood that the phraseology or terminology used herein is for the purpose of description and not limitation. Hence, although the present description has been provided hereinabove by way of non-restrictive illustrative embodiments thereof, it can be modified, without departing from the scope, spirit and nature of the appended claims.

What is claimed is:

1. A louver blind structure for a double glazed window comprising:

a frame comprising top, bottom and opposite lateral interconnected members defining an inner frame side for fixedly surrounding the double glazed window and an opposite outer frame side;

a plurality of louver members pivotally mounted at each longitudinal end thereof to said inner frame side within the double glazed window so as to pivot between open and closed positions without engaging the double glazed window, each louver member having a hollow and rectangular elongated structure;

one of said opposite lateral members comprising a main body and an auxiliary body defining a channel therebetween at said inner frame side, said main body defining shoulders, said auxiliary body comprising flanges for being clipped onto said shoulders;

each said louver member comprising a sleeve at one longitudinal end thereof, said one longitudinal end defining a rectangular configuration having a height and a width, said sleeve being positioned at a middle portion along the height of said longitudinal end, said sleeve receiving a pivot member, said pivot member comprising an elongated pivot body positioned within said sleeve and a gear at one end thereof protruding outwardly of said louver member;

an elongated member mounted within said channel and comprising a plurality of openings, each of said openings receiving a respective said gear, said elongated member being movable between upward and downward directions within said channel relative to said frame for engaging each said gear thereby imparting a pivot movement to said louver members;

at least one actuator mounted to said outer frame side and protruding through said frame for selectively imparting a movement to said elongated member, wherein imparting a movement to said elongated member causes said louver members engaged thereby to pivot between the open and closed positions.

2. A louver blind structure according to claim 1, wherein said actuator comprises a cam for engaging said elongated member.

3. A louver blind structure according to claim 2, wherein said elongated member comprises a slot for being engaged by said actuator.

4. A louver blind structure according to claim 1, wherein said actuator comprises a control for selectively imparting a movement to said elongated member.

5. A louver blind structure according to claim 4, wherein said control comprises a manual control.

6. A louver blind structure according to claim 5, wherein said manual control comprises a gear.

7. A louver blind structure according to claim 4, wherein said control comprises a motor.

8. A louver blind structure according to claim 4, wherein said control actuates a gear assembly for imparting a movement to said elongated member.

9. A louver blind structure according to claim 1, wherein said actuator comprises:

a rectangular base member having a longitudinal slot to receive a worm gear for acting on a first circular gear element fitted within a cavity formed in said base;

a rectangular cover mounted to said base member;

said first circular gear element receiving a longitudinal gear rod comprising a circular base portion with a flat part fitted within a corresponding opening of said first circular gear element so as to rotate therewith;

said gear rod comprising a head portion that is inserted within a tubular structure formed within and extending from said cover;

said head portion being mounted within an opening of a second circular gear element slidably mounted to said tubular structure and cam eccentrically protruding therefrom for engaging said elongated member; and a roller rollingly mounted about said cam, wherein actuation of said worm gear causes said first circular gear to rotate thereby rotating therewith said gear rod which in turn rotates said second circular gear causing said cam to engage said elongated member so as to selectively impart an upward or downward movement thereto.

* * * * *